United States Patent [19]

Hirt et al.

[11] Patent Number: 4,662,997

[45] Date of Patent: May 5, 1987

[54] METHOD AND APPARATUS FOR ENERGIZING METALLIC STRIP FOR PLATING

[76] Inventors: Theodore A. Hirt, 609 Perkins Dr., N.W., Warren, Ohio 44483; James R. Holmstrom, 8585 Carriage Hill, N.E., Warren, Ohio 44484

[21] Appl. No.: 856,580

[22] Filed: Apr. 25, 1986

[51] Int. Cl.[4] ..... C25D 7/06; C25D 17/00

[52] U.S. Cl. ..... 204/28; 204/206; 204/279

[58] Field of Search ..... 204/28, 206, 211, 279; 191/1 A

[56] References Cited

U.S. PATENT DOCUMENTS

| | | | |
|---|---|---|---|
| 2,414,543 | 1/1947 | Moberly | 310/228 |
| 2,446,548 | 8/1948 | Nachtman | 204/211 |
| 2,969,437 | 1/1961 | Rayburn | 191/1 A |
| 3,005,078 | 10/1961 | Mottu et al. | 200/260 |
| 3,021,497 | 2/1962 | Riley | 339/5 |
| 3,328,281 | 6/1967 | Marshall | 204/279 |
| 3,375,479 | 3/1968 | Lowe | 339/5 |
| 3,678,226 | 7/1972 | Hatagi et al. | 191/1 A |
| 3,839,606 | 10/1974 | Paradine | 191/1 A |
| 3,887,776 | 6/1975 | Kanbayashi | 191/1 A |
| 3,900,383 | 8/1975 | Austin et al. | 204/211 |
| 4,101,186 | 7/1978 | Georgiev et al. | 339/55 |
| 4,304,654 | 12/1981 | Norris | 204/212 |
| 4,468,069 | 8/1984 | Meal et al. | 339/6 A |

*Primary Examiner*—T. M. Tufariello

*Attorney, Agent, or Firm*—Watts, Hoffmann, Fisher & Heinke Co.

[57] ABSTRACT

A novel contact roll assembly particularly suited for use in electro-chemical plating of metallic strip. A contact roll is rotatably mounted on a stationary support which is attached to a bus bar. Regions of contact between the stationary support and the contact roll are preferably by metallic inserts carried by the support. The inserts not only provide support for the contact roll but also provide bearing surfaces for journalling the roll and provide large surface contact areas for flow of plating current.

26 Claims, 9 Drawing Figures

Fig. 8
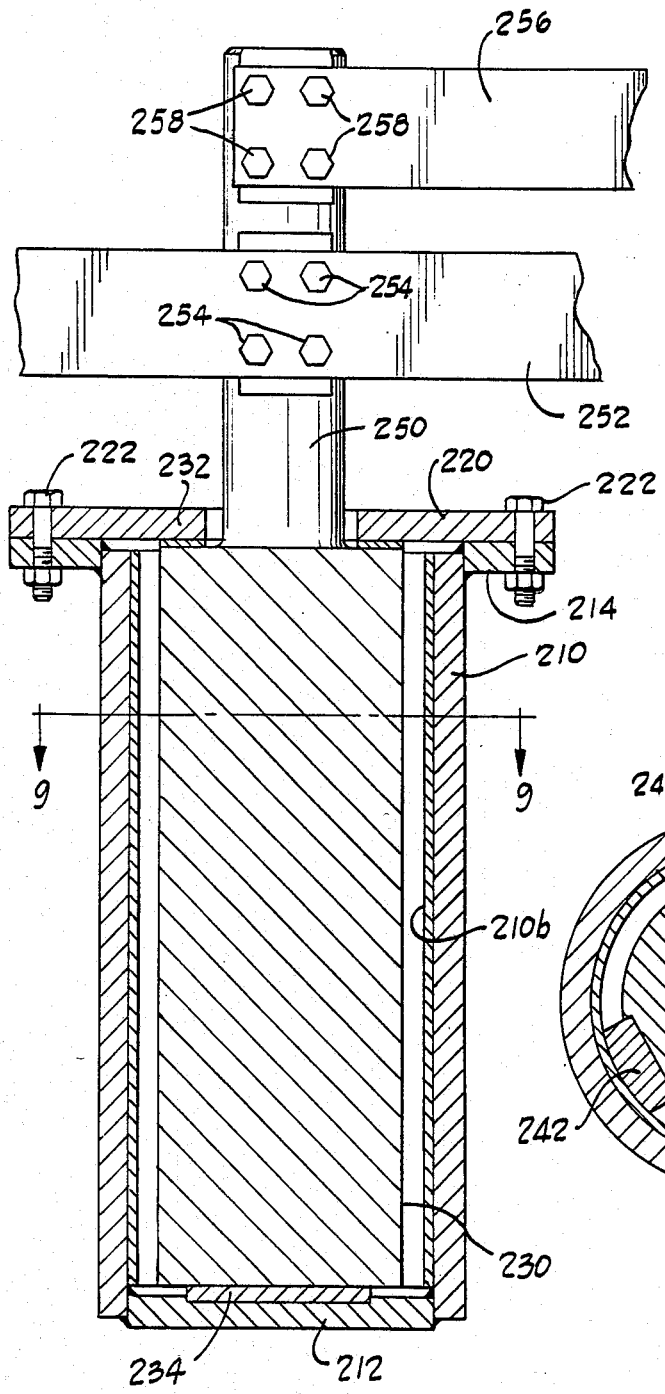
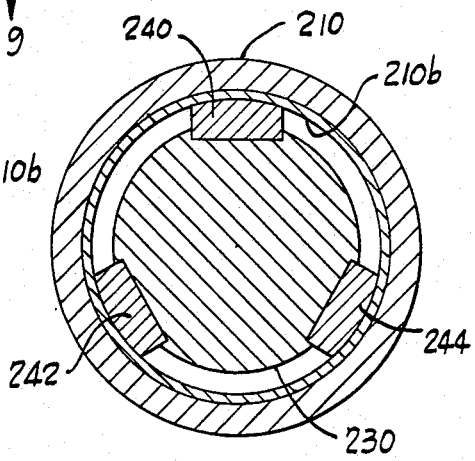
Fig. 9

METHOD AND APPARATUS FOR ENERGIZING METALLIC STRIP FOR PLATING

TECHNICAL FIELD

The present invention relates to method and apparatus for energizing a strip utilizing a novel contact roll and more particularly to an electro-plating system using the improved contact roll.

BACKGROUND ART

A standard method of plating metallic strip is to move the strip through plating bathes having a high concentration of metal ions in solution. An electrical potential is maintained between the strip and the bath causing an electro-chemical reaction to take place. Metallic ions in the bath combine with electrons to form a metallic layer on the surface of the strip. Zinc plating or galvanizing of steel for rustproofing the steel is an example of metallic strip plating accomplished in this manner.

The processing steps for electro-plating strip metal are well known. A coil of metallic strip is unwound and attached to the trailing end of a preceding coil at a welding station. From this station, the strip moves through preparation stations where typically the surface of the strip is cleaned and acid treated to prepare it for plating. The drive rollers then feed the strip over a contact roll that energizes the strip as it is fed into a plating bath in a cell. As the strip exits the cell it passes over another contact roll. Usually a strip plating line will have a series of such cells through which the strip is sequentially fed. The plating is performed under controlled conditions wherein typically the thickness of the plating is monitored and plating current and line speed are adjusted to produce a desired plating thickness. The plated strip is then washed, dried and recoiled for shipment.

Since efficient plating requires high levels of electric energy and that energy is fed through rotating contact rolls in the harsh environment of a plating line, the provision of suitable commutation for delivering energy to contact rolls has been a persistant problem. A myriad of constructions have been tried and used but all have shortcomings. Typically a rotating contact roll is supported by a shaft that is journalled for rotation in support bearings. Electrical energy is applied to the shaft by a commutator, typically including a brush and slip ring. Two patents illustrative of this approach contact roll energization design are U.S. Pat. No. 3,678,226 to Hatagi et al. and U.S. Pat. No. 3,839,606 to Paradine. Experience with these prior art designs has shown that the bearings and commutators typically form the weakest part of the contact roll arrangement and most frequently require adjustment, maintenance, and replacement.

DISCLOSURE OF THE INVENTION

The present invention relates to a contact roll assembly for energizing a metallic strip. The invention needs no commutator mechanism, nor does it require the shaft bearings of the prior art. The assembly of the invention includes a fixed stator that acts as both a support bearing and as a commutator. A tubular rotor or contact roll supported by the stator, contacts the strip and rotates as a strip is fed along its path.

A preferred use of the invention is in conjunction with an electro-plating system. The stator includes a conductive stationary support member which extends beyond the end of the tubular contact roll and is electrically energized by a source of plating current. A conductive contact member carried by the support member acts as both a bearing and commutator. Preferably the contact member extends a substantial length along the support to contact the rotatable contact roll substantially from one end of the roll to the other. This results in a wide load distribution and a large area for electrical contact.

An interior surface of the tubular contact roll includes a bearing surface that engages the contact member. Pressure from a strip assures good electrical contact between the roll and contact members. Rotation of the contact roll over time causes the contact member bearing material to wear. When this happens the support can be rotated to a different orientation so that the contact roll inner surface engages different contact bearing surfaces.

The stationary support preferably defines a through passage for a liquid coolant. The support may also define apertures to allow liquid entering the through passage to pass through the support and directly contact the contact roll. This dissipates heat that may build up in the contact roll. The liquid also functions as a bearing surface lubricant.

The new and improved contact roll is suitable for delivery up to 50,000 amperes of current to the contact roll. 25,000 amperes are supplied on each side of the contact roll by buss bars coupled to the stationary support.

The invention has utility in other applications that require the electric potential on a metallic strip to be controlled. The contact roll of the invention can be used, for example, in induction heat treating of a moving metal strip via electrical energization. The contact roll can also be used to electrically ground a moving strip.

In an alternate embodiment of the invention, the stationary support is vertically oriented. The outer contact roll slips over an inner support and is rotatably supported by a thrust bearing. As in the horizontal embodiment of the invention, the rotating contact roll has an inner bearing surface that engages a conductor running the length of the inner support cylinder. This alternate embodiment of the invention is used for plating relatively narrow metallic strip that can be supported with the strip's transverse dimension vertical.

An object of the invention is the provision of a plating method and apparatus including new and improved contact roll for use in plating metallic strip. This and other objects, advantages and features of the invention will become better understood when embodiments of the invention are described in conjunction with the accompanying drawings.

BRIEF DESCRIPTION OF DRAWINGS

FIG. 8 is a partially sectioned view of a vertically oriented contact roll assembly; and FIG. 9 is a sectioned view as seen from the plane indicated by the line 9—9 of FIG. 8.

BEST MODE FOR CARRYING OUT THE INVENTION

Figure 1:
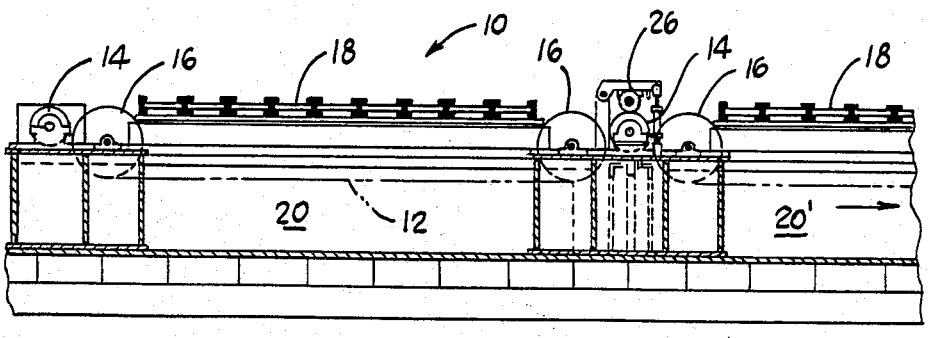
FIG. 1 is a schematic elevation view of a portion of a plating line showing a number of plating cells.
Figure 2:
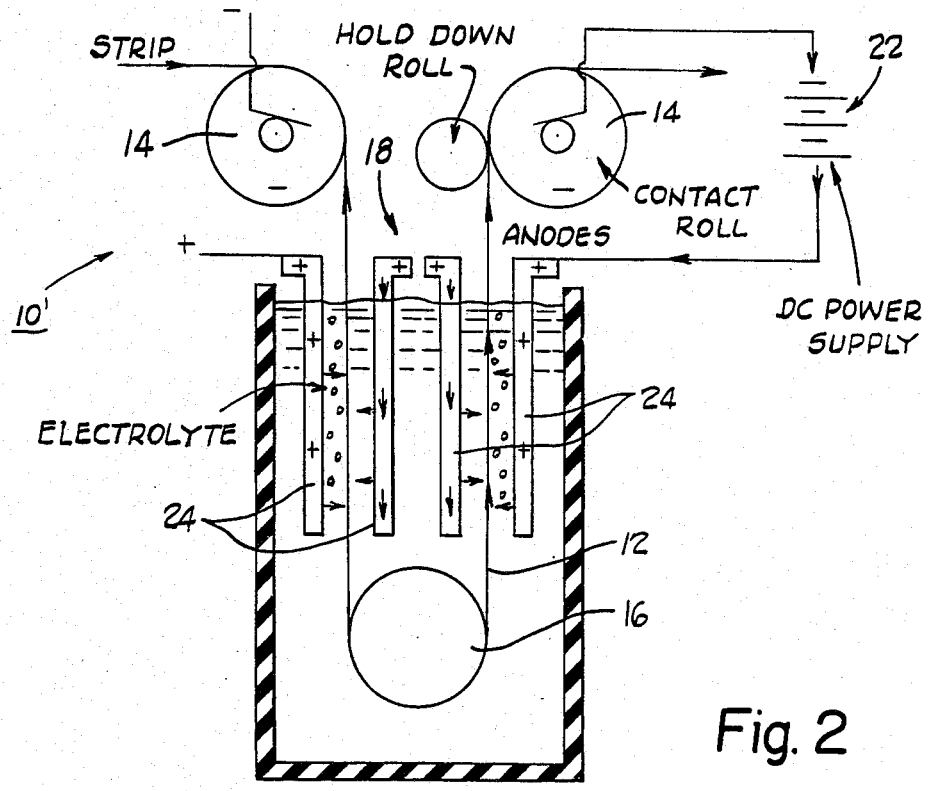
FIG. 2 is a schematic elevation view of an alternate plating line.

Turning now to the drawings, FIGS. 1 and 2 schematically illustrate two electro-plating lines 10, 10'. In both lines 10, 10' a metallic strip 12 moves along a travel path defined by contact 14 and sinker 16 rolls that direct the strip 12 through a plating bath in the vicinity of one or more multiple anode plating cells 18. A power supply 22 (FIG. 2) energizes the contact rolls 14 and plating anodes 24 suspended within the bath. Electrical contact between the strip 12 and contact rolls 14 produces a voltage difference between the strip 12 and anodes 24, resulting in the plating of metallic layers onto both sides of the strip.

The FIG. 1 electro-plating line 10 illustrates a plurality of plating cells 18. Two or more cells can share the same plating bath. If the cells 18 plate different substances or use different ion concentrations, however, they use separate baths. The FIG. 1 plating cells 18 are separated from each other. As the strip 12 leaves a first bath 20 a squeeze roll 26 deflects solution leaving the bath 20. This helps maintain the uniformity of a second bath 20' by preventing solution from the first bath 20 from reaching the second.

Figure 3:
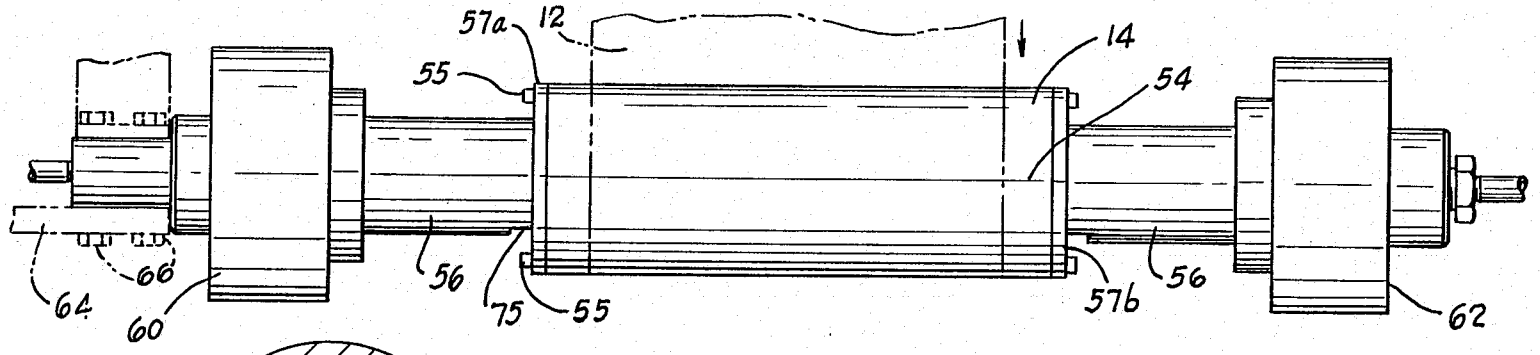
FIG. 3 is a top plan view of a contact roll assembly.

In FIG. 3, a plating contact roll 14 is shown positioned relative a strip path of travel. The strip 12 is reeved over the contact roll 14 and is in electrical contact with the roll across its entire width.

The roll 14 is mounted for rotation so that movement of the metallic strip 12 over it causes rotation of the roll 14 about an axis 54. In the FIG. 3 embodiment, the strip 12 is tensioned by drive rolls (not shown) that tension and provide a motive force to the strip. The tensioning of the strip 12 in combination with the weight of the strip exert a force on the roll 14 that ensures effective bearing and electrical contact between the roll 14 and its support structure.

Figure 4:
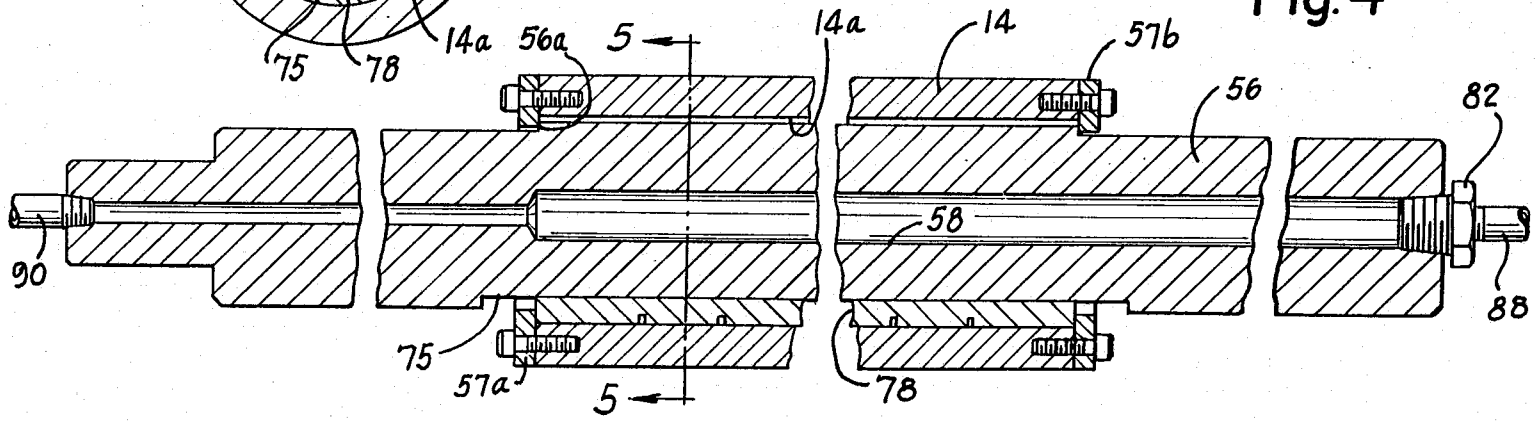
FIG. 4 is a sectioned view on a larger scale of the contact roll and support of the FIG. 3 assembly.

The contact roll 14 is tubular and is supported on a support structure including a stationary metal shaft or support 56 passing through and extending on either side of the roll 14. The axial position of the roll 14 on the shaft 56 is controlled by two thrust rings 57*a*, 57*b* attached to end surfaces of the contact roll as by threaded connectors 55. The stationary shaft 56 is preferably constructed from copper and defines a center passage 58 (FIG. 4). A coolant is routed through the passage 58 to cool the shaft 56 and the roll 14. Spaced supports 60, 62 are near either ehd of the shaft 56 and provide stationary support for the shaft. A power supply busbar 64 is connected to the shaft 56 by threaded connectors 66 for providing plating current to the strip 52 through the contact roll 50.

Figure 5:
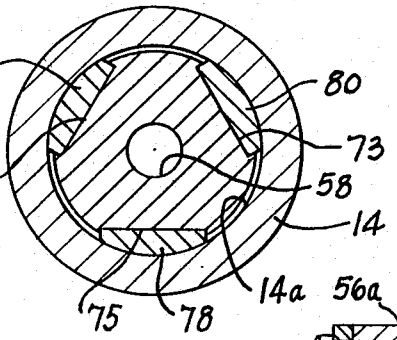
FIG. 5 is a sectioned view as seen from the plane indicated by line 5—5 of FIG. 4.

As seen in the sectioned views of FIGS. 4 and 5, the shaft 56 includes an enlarged diameter portion 56*a* that is telescoped within and supports the contact roll 14 for rotation about the center axis 54. The enlarged portion 56*a* includes three longitudinally extending notches 73, 74, 75 (FIG. 5). The notches are equally spaced circumferentially and respectively accommodate three elongated metallic inserts 76, 78, 80 which also form a part of the support structure. In use, outer surfaces of two of these inserts directly contact an inner surface 14*a* of the contact roll 14 and provide bearing support for the roll as it rotates.

Due to the tensioning of the strip 12 against the contact roll 14, the inner surface 14*a* will press most strongly against the inserts 76 and 80. A small gap will exist between the insert 78 and the contact roll inner surface 14*a*. With use, the insert outer surfaces wear and become seated in good surface contact with the contact roll. This surface contact provides two large areas for electrical transfer and therefore, at least as compared with commutators used with prior contact rolls, low current densities. Because the inserts do wear it is desirable to periodically rotate the center shaft 56 to make that wear more uniform amongst the three inserts 76, 78, 80.

In the embodiment shown in FIGS. 3–5, contact roll cooling is accomplished by coolant (preferably water) that is directed through the shaft passage 58. A ⅜ inch to 1 inch adapter 82 threadingly engages one end of the shaft 56. Fluid carrying conduits 88, 90 route coolant to and from the shaft passage 58. The diameter of the through passage 58 can be increased or decreased to select the surface area of the shaft that is contacted with coolant. Heat transfer from the shaft to the coolant is also controlled by adjusting the coolant flow rate.

A preferred shaft 56 is a copper forging and the contact roll is of a suitable metallic material different than that of the inserts 76, 78, 80 and whose inner surface can be machined to provide a bearing surface to contact the insert 76, 78, 80. These inserts are constructed of a metallic conductor/bearing material such as Metaline that is resistent to wear and provides good electrical conductivity to the contact roll 50. Metaline is a special compound of metallic, oxides, waxes, white metals, organic salts, and grophite commercially available from Spadone-Alfa Corporation of Norwalk, Conn. 06856.

Figures 6, 7:
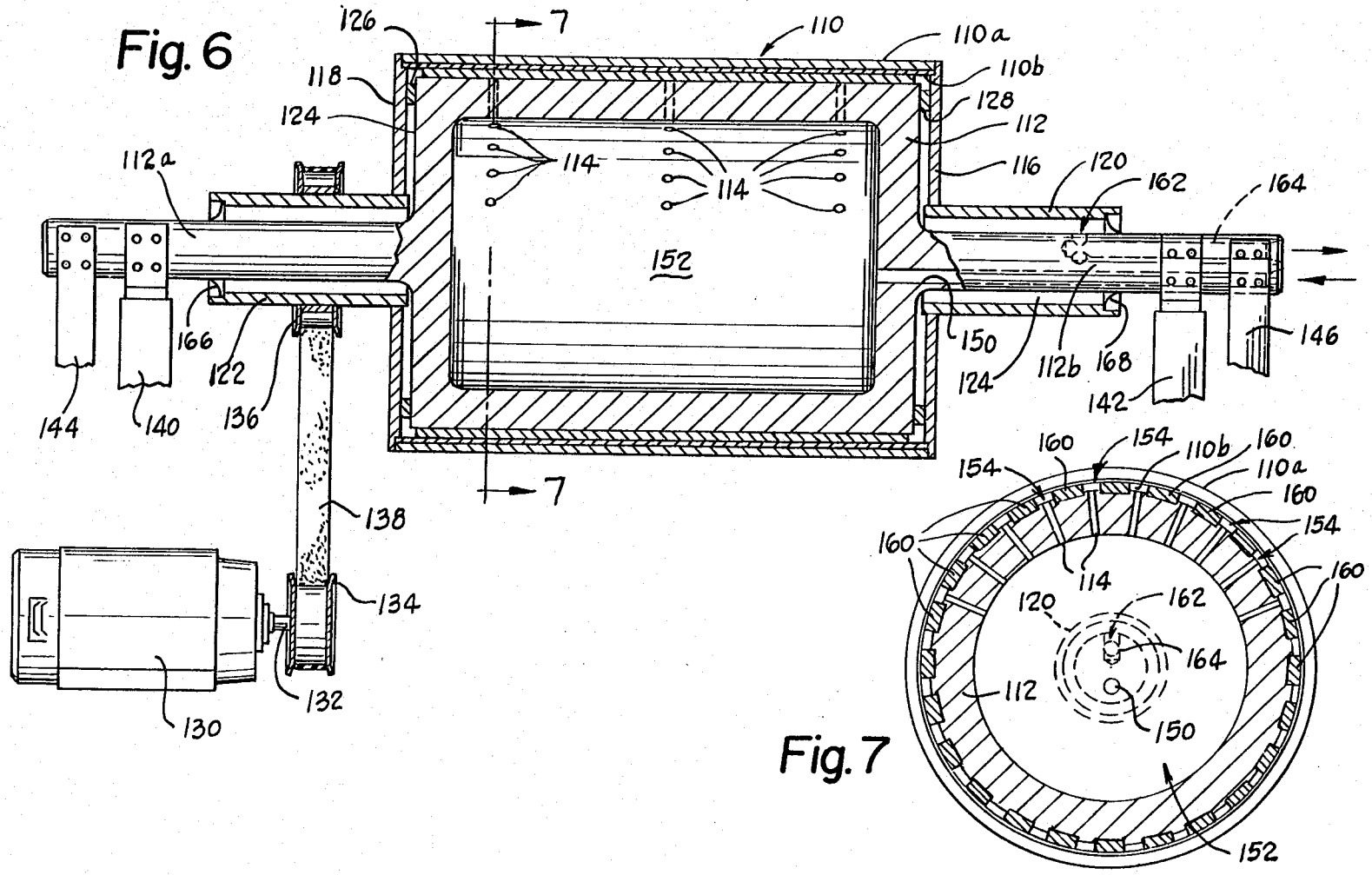
FIG. 6 is a partially sectioned view of another embodiment of the invention.
FIG. 7 is a sectioned view as seen from the plane indicated by the line 7—7 of FIG. 6.

An alternate embodiment of a horizontally oriented contact roll 110 is illustrated in FIGS. 6 and 7. The contact roll 110 of FIGS. 6 and 7 is mounted on a tubular support 112 having a central section 112*c* defining apertures 114 that allow coolant to come into contact with a tubular section 111 of the contact roll 110.

The section 111 is of a two-layer construction having an outer metallic shell 110*a* in circumferential engagement with an inner bearing material layer 111*b*. Two contact roll end pieces 116, 118 are attached to the tubular section 111 by welding or the like. These end pieces 116, 118 are welded to two tubular, axially extending metallic members 120, 122. The end pieces 116, 118 and tubular members 120, 122 are spaced from the support center 112 section and define spaced regions 124 for return of coolant exiting from between the sleeve and the support.

Two thrust bearings 126, 128 are respectively positioned to locate the support center section 112 in an axial direction and control the position of the contact roll 110 in transverse relation to a work piece travel path.

Unlike the embodiment of FIGS. 3–5, the FIG. 6 embodiment of the contact roll 110 is driven by a motor 130. The motor has an output shaft 132 coupled to an output pulley 134. A driven pulley 136 is fixed to the tubular member 122 and drives through a belt 138 which is received over the pulleys 134, 136.

The tubular support 112 has spaced, reduced diameter, axially extending, shaft portions 112*a*, 112*b*. Near outer ends of these portions, the support 112 is fixed to two supports 140, 142 that bear the weight of the contact roll 110 and tubular support 112. Bus bars 144, 146 are respectively connected to the shaft portions 112*a*, 112*b*. In the illustrated embodiment in FIG. 6, each bus 144, 146 is designed to carry up to 25,000 amperes of plating current to produce a combined capability of 50,000 amperes of plating current through the contact roll 110.

The support shaft 112*b* defines an inlet passageway 150 for the routing of coolant into an interior volume 152 of the tubular support. As seen most clearly in FIG. 7, after reaching this interior volume 152 this coolant passes upwardly and radially through the apertures 114 in the tubular support 112 to upper ones of regions 154 intermediate the support 112 and the inner bearing surface 111*b* of the contact roll 110. A plurality of circumferentially spaced metallic inserts 160 each extend longitudinally over substantially the entire length of the tubular support 112. The regions 154 are spaces between the inserts 160.

As in the FIG. 3 embodiment, tensioning of the metallic strip to be plated and the weight of the contact roll 110 causes the roll to bear against upper ones of the inserts 160. The tubular support 112 can periodically be adjustably rotated about its axis to distribute the wear of the metallic inserts and ensure this wear occurs more uniformly throughout the life of the contact roll.

When the support 112 is rotated to ensure even wear of the inserts 160 certain of the apertures 114 are plugged and others that were formerly plugged are opened. This insures coolant does not begin to escape from the support until the support is well over half filled to assure substantially the entire contact roll 110 is contacted with coolant.

Regardless of the orientation of the support 112, coolant flows into the center volume 152, and flows out the apertures 114 and into communicating ones of the regions 154.

The coolant flows across the length of the contact roll tubular section 111 to the regions 124 between the support center section 112*c* and the end pieces 116, 118 and between the spaced shaft portions 112*b*, 112*a* and tubular members 120, 122. The coolant exits these regions 124 through one or more openings 162, one of which is shown in the shaft portion 112*b*, and is routed away through outlet passageways, one of which is shown at 164. In applications requiring high cooling rates a mirror image opening and outlet passage could be provided in the second shaft portion 112*a*.

Spaced end seals 166, 168 allow rotation of the tubular members 120, 122 about the shaft portions 112*b*, 112*a* while inhibiting the escape of coolant from the regions 124. As in the FIGS. 3–5 embodiment of the invention, a preferred coolant is water.

Turning now to FIGS. 8 and 9, a third embodiment of the invention is disclosed. This embodiment has vertically oriented contact rolls which are usefull in lines such as those used for plating relatively narrow metallic strip. The FIG. 8 embodiment includes a contact roll 210. A disk-like lower end piece 212 and an annular upper end piece 214 are connected to the contact roll 210. The contact roll 210 is supported in its vertical orientation by a supporting keeper plate 220 connected to the annular end plate 214 by threaded connectors 222 or the like.

A stationary center support 230 bears the weight of the keeper plate 220 and the contact roll 210 through a thrust bearing 232. A lower thrust bearing 234 is provided to prevent the roll from riding up on the support 230.

As in the. FIG. 3 embodiment of the invention, the support 230 carries three metallic inserts 240, 242, 244 that are equally spaced about its circumference. The insert contact an inner bearing surface 210*b* of the contact roll 210. During use a metallic strip to be plated is reaved partially around the contact roll 210 and tensioned so that electrical contact is maintained between the support and contact roll through two of the metallic inserts.

As shown, the FIG. 8 embodiment does not have coolant flow passages. If desired, passages for liquid coolant corresponding to those disclosed in the other embodiments can be included in the support 230. Instead of flowing completely through the support, the coolant can be routed into and out of the support through a conductive shaft 250. The shaft 250 and support 230 are preferably constructed as a unitary copper forging connected to a supporting bar 252 of an electrically insulating material by connectors 254. A bus bar 256 is electrically connected to the shaft 250 by connectors 258 to supply plating current to the contact roll 210.

The three embodiments of the invention have been described for use in an electro-plating system. The invention has utility, however, in any application where an electric potential is coupled to a moving metallic strip such as where electrical energization is used to heat the strip. It is therefore the intent that the invention include all variations and alterations from the disclosed embodiments falling within the spirit or scope of the appended claims.

We claim:

1. Plating apparatus for electro-plating metallic strip comprising:

plating means including a container having a volume for holding a fluid having a concentration of metal ions in solution;

path defining means for directing the metallic strip through the volume;

a rotatable tubular contact roll for contacting the metallic strip in the vicinity of the container;

a conductive support structure supporting the contact roll to position the roll along a strip path of travel, the support structure extending beyond at least one end of said contact roll;

mounting means fixing the support structure and adapted to absorb forces from the support structure and the contact roll as a plating strip engages said roll;

conductive support structure, including conductive bearing surfaces to rotatably support said roll, said surfaces extending longitudinally of the support member to contact said roll at elongated electrical contact regions on an inner surface of the tubular contact roll; and energizing means coupled to the support structure to energize the contact roll.

2. The apparatus of claim 1 wherein the support structure includes inserts defining said bearing surfaces.

3. Plating apparatus comprising:

a tubular plating roll having inner and outer surfaces, said outer surface being adapted to engage a metallic strip and to electrically energize such strip during plating, said inner surface defining a plating roll bearing surface;

stationary support structure including a support bearing surface coactable with the plating roll bearing surface to provide journalling support for the roll, said support structure extending beyond at least one end of the tubular plating roll and electrically coupleable to a source of plating current; said support structure defining a passageway for the admission of a liquid coolant; and drive means for rotating the plating roll relative the stationary support means.

4. The apparatus of claim 3 wherein the support structure includes an insert defining the support bearing surface.

5. The plating apparatus of claim 3 wherein the support structure defines a hollow interior volume within the roll and includes spaced, reduced diameter, shaft portions near either end that each extend beyond the plating roll.

6. The plating apparatus of claim 4 additionally comprising first and second end caps coupleable to the plating roll where each end cap defines an opening through which the elongated shaft portions extend.

7. The plating apparatus of claim 5 wherein the hollow volume is connected by one or more apertures to a region between the support structure and said plating roll.

8. A method of electrically energizing metallic strip for electro-chemical plating comprising the steps of:

supporting a tubular contact roll for rotation on a stationary non-rotating support having an outer surface that engages an inner surface of the tubular contact roll;

electrically energizing the support with a source of plating current;

cooling the contact roll by routing a coolant through the support; and routing a strip of metal into contact with the contact roll as it rotates in close proximity to a plating bath.

9. The method of claim 8 wherein the cylindrical support has extentions projecting beyond either end of the tubular contact roll and the energizing step is accomplished by coupling both extensions to sources of plating current.

10. Apparatus for providing a plating current to electro-chemically plate a metallic strip as said strip moves through a plating bath comprising:

a rotatable conductive tubular contact roll for contacting such metallic strip to electrically energize such strip;

a stationary conductive support supporting the roll in a position to contact such strip along a path of travel;

mounting means to support the conductive support member relative to such path of travel;

conductive contact means carried by the conductive support to journal said roll for rotation, said contact means extending radially outward from the support to contact said roll at spaced contact regions of an inner surface of the tubular contact roll; and energizing means electrically coupled to the support to energize said support member and provide plating current.

11. The apparatus of claim 10 wherein the contact roll comprises an outer strip contact shell and an inner bearing layer having an inner surface for engaging the conductive contact means.

12. The apparatus of claim 11 wherein the conductive support is a metal shaft extending through the contact roll, said apparatus further comprising metallic ring means each attached to a selected one of roll and shaft near either end of the roll to position relatively and axially the roll and the shaft.

13. The apparatus of claim 12 wherein the shaft defines coolant passages for routing coolant into and out of said shaft.

14. Plating apparatus comprising:

a tubular plating roll having inner and outer surfaces, said outer surface being adapted to engage a metallic strip to electrically energize the strip during plating, said inner surface defining a plating roll bearing surface;

stationary support means at least in part disposed within the roll and defining a support bearing surface to engage the roll bearing surface, said stationary support means including a hollow portion having an internal volume and spaced reduced diameter shaft portions extending away from either end of the hollow portion beyond the ends of the roll, at least one of said shaft portions defining a coolant passageway for the admission of a coolant to the volume to cool said plating roll; and electrical means for energizing at least one of said shaft portions to provide a plating current to the strip through the contact roll.

15. The plating apparatus of claim 14 wherein said support means includes apertures communicating the coolant volume with a region between the contact roll and the stationary support.

16. The apparatus of claim 15 wherein the ends of the roll are respectively partially enclosed by end pieces that define further regions between the pieces and the support means.

17. The apparatus of claim 14 wherein the hollow portion includes elongated metallic contact members circumferentially spaced from each other about the hollow portion, the contact members being for slidingly engaging the plating roll bearing surface.

18. Plating apparatus for energizing metallic strip at a location along a strip travel path comprising:

a vertically supported metal structure having a reduced diameter mounting portion adjacent one end, said member including a shoulder around the mounting portion;

a plurality of metal contact members coupled to and extending along a length of the supported structure below the shoulder;

a metal strip contact roll rotatably supported on the shoulder and having an inner surface contacting at least one of the metal contact members; and energizing means coupled to the supported structure to provide plating current to the strip through a conductive path from the supported structure, through the metal contact members, and then to the contact roll.

19. Apparatus comprising:

a tubular contact roll having inner and outer surfaces, said outer surface being adapted to engage a metallic strip to maintain an electric potential on such strip, said inner surface defining a contact roll bearing surface; and stationary support structure including a support bearing surface coactable with the contact roll bearing surface to provide journalling support for the contact roll, said support structure extending beyond at least one end of the tubular contact roll and electrically coupleable to a source of electric potential.

20. The apparatus of claim 19 wherein the support structure includes an insert defining the support bearing surface.

21. The apparatus of claim 19 wherein the support structure defines a hollow interior volume within the roll and includes spaced, reduced diameter, elongated shaft portions near either end that each extend beyond the contact roll.

22. The plating apparatus of claim 21 additionally comprising first and second end caps coupleable to the contact roll where each end cap defines an opening through which the elongated shaft portions extend.

23. The plating apparatus of claim 21 wherein the hollow interior volume is connected by one or more apertures to a region between the support structure and said contact roll.

24. A method of electrically energizing metallic strip comprising the steps of:

supporting a tubular contact roll for rotation on a stationary non-rotating support having an outer surface that engages an inner surface of the tubular contact roll;

electrically energizing the support with a source of electric potential;

cooling the contact roll by routing a coolant through the support; and routing a strip of metal into moving contact with the contact roll as said contact roll rotates with respect to said strip.

25. The method of claim 24 wherein the cylindrical support has extentions projecting beyond either end of the tubular contact roll and the energizing step is accomplished by coupling both extensions to sources of electric potential.

26. Apparatus for applying an electric potential to a metallic strip comprising:

a rotatable conductive tubular contact roll for contacting such metallic strip to electrically energize such strip;

a stationary conductive support supporting the roll in a position to contact such strip along a path of travel;

mounting means to support the conductive support member relative to such path of travel;

conductive contact means carried by the conductive support to journal said roll for rotation, said contact means extending radially outward from the support to contact said roll at spaced contact regions of an inner surface of the tubular contact roll; and means coupled to the support to apply an electric potential to the contact roll.

* * * * *